US006016819A

United States Patent [19]

Murray et al.

[11] Patent Number: 6,016,819

[45] Date of Patent: Jan. 25, 2000

[54] HIGH TURBULENCE MULTIPLE STAGE WIRE PICKLING SYSTEM

[76] Inventors: Gordon Murray, 132 St. Louis Ave., Beaconsfield, Qc, Canada, H9W 4Y3; William E Crowle, 303 St. Julien, Rigaud Qc., Canada, J0P 1P0

[21] Appl. No.: 09/053,708

[22] Filed: Apr. 2, 1998

Related U.S. Application Data

[60] Provisional application No. 60/042,511, Apr. 4, 1997.

[51] Int. Cl.[7] ..... B08B 3/00

[52] U.S. Cl. ..... 134/64 R; 134/122 R; 134/199

[58] Field of Search ..... 134/64 R, 122 R, 134/199, 64 P, 122 P

[56] References Cited

U.S. PATENT DOCUMENTS

| | | | |
|---|---|---|---|
| 3,552,404 | 1/1971 | Kuhn | 134/2 |
| 4,167,424 | 9/1979 | Jubenville et al. | 134/1 |
| 4,270,317 | 6/1981 | Kurie | 51/426 |
| 4,391,692 | 7/1983 | Mindt | 204/206 |
| 4,592,784 | 6/1986 | Ghizzi | 134/15 |
| 4,807,653 | 2/1989 | Cipriano et al. | 134/64 |
| 4,950,333 | 8/1990 | Hone et al. | 134/15 |
| 4,951,694 | 8/1990 | Hone et al. | 134/64 R |
| 5,116,447 | 5/1992 | Kimura et al. | 156/345 |
| 5,195,547 | 3/1993 | Devens | 134/114 |
| 5,282,485 | 2/1994 | Hirai et al. | 134/64 R |
| 5,395,454 | 3/1995 | Robert | 134/6 |
| 5,407,544 | 4/1995 | Oehr et al. | 204/141.5 |
| 5,409,594 | 4/1995 | Al-Jiboory et al. | 205/148 |

OTHER PUBLICATIONS

Pempera, F.G. et al "Turbulent Shallow–Type Pickling Lines" Iron and Steel Engineer, Mar. 1988, pp. 33–36.

Crowle, W.E., Murray, G.A., "Enclosed Acid Wave Pickling System" Conference Proceedings, 58th Annual Convention, Toronto, 1988.

Wire Association International pp. 81–87.

*Primary Examiner*—Jill Warden
*Assistant Examiner*—Paul J. Lee

[57] ABSTRACT

This invention concerns a novel pickling apparatus for removing oxides from the surface of a plurality of parallel laterally spaced wires, continuously moving axially through an enclosed pickling area. The pickling area encompasses one or more sections of turbulent hot acid (hydrochloric or other) pickling liquor submerging the wires. Each section essentially comprises a flooded turbulent processing tray, corrosion resistant centrifugal re-circulating pump, lower reservoir tank and wire wiping components. The pickling fluid is pumped from the lower reservoir tank into the processing tray through laterally (with respect to wire direction) mounted headers. Each header has a plurality of holes to discharge the fluid into the process tray in highly turbulent manner. Weirs at each end of the tray support the wires and flood the tray. The acid sections can be operated at different acid concentration levels by introducing fresh acid to the final section and cascading the overflow to the other sections in a direction opposite to that of the wire. Alternatively, all sections can be operated at the same concentration by connecting piping. The pickling area is enclosed at each end by water curtains, and on the top, bottom and sides by solid corrosion resistant walls. The wire entry end has a singe or double water curtain fed through a corrosion resistant pump from a reservoir tank. The wire exit end has two or three rinse sections to remove the acid from the wires. Each rinse section also incorporates a water curtain to seal in acid fumes.

8 Claims, 6 Drawing Sheets

HIGH TURBULENCE MULTIPLE STAGE WIRE PICKLING SYSTEM

BACKGROUND—CROSS REFERENCES TO RELATED APPLICATIONS

This application claims the benefit of Provisional Patent Application Ser. No. 60/042,511, filed Apr. 4, 1997.

BACKGROUND—FIELD OF INVENTION

This invention relates to pickling or metal cleaning systems, specifically to enclosed, wire pickling systems.

BACKGROUND—DISCUSSION OF PRIOR ART

Originally continuous wire pickling systems were open baths of acid with mechanical devices (sinkers) used to submerge the wires. Later developments included the heating of the acid and the addition of covers with fume extractors. A subsequent improvement was the "flood weir" system in which the acid is pumped from a lower reservoir tank to the processing tray before overflowing back to the reservoir, thus eliminating the need for sinkers. The acid velocity in a typical flood weir processing tray is slow and laminar. With the advent of water seals such as U.S. Pat. No. 4,592,784 by Ghizzi in Jul. 2, 1984 (expired), wire pickling systems became known as "fumeless".

One of the more recent developments in continuous wire pickling systems is U.S. Pat. Nos. 4,951,694 and 4,950,333 by Hone et al for the "hydraulic jump" type of wire pickling apparatus. This design has permitted an increase in wire speeds but has the disadvantages of a relatively short turbulent region confined to only one acid section. During a pickling operation the acid becomes chemically depleted thus necessitating the dumping of part of the tank so that fresh acid can be added. Since the hydraulic jump system has only one acid section, a large volume of fluid must be drained each time fresh acid is required. Another disadvantage is that a large and expensive acid pump is required to create a hydraulic jump.

Others including; Kurie U.S. Pat. No. 4,270,317), Ciprianо et al (U.S. Pat. No. 4,807,653), Kimura et al (U.S. Pat. No. 5,116,447) and Hirai et al (U.S. Pat. No. 5,282,485) have developed various types of turbulent pickling systems for continuously moving sheet material or strip. Their systems are generally complex and thus expensive and are not suitably designed for the geometry of wire.

OBJECTS AND ADVANTAGES

Accordingly, several objects and advantages of our invention are

1. The system is designed for a plurality of turbulent acid sections. Each individual acid section has optimized turbulence and thus the wires are effectively cleaned in a short distance. The system can be tailored to suit the wire speed of any wire processing line selecting one, two, three or more acid sections. This minimizes the cost of the system and decreases the chance of "over-pickling".
2. The acid sections can operate at different temperatures and acid concentrations. As the concentration lowers in a pickling section, the partially spent acid need not be dumped, but can be transferred to next upstream (with regards to the direction of wire movement) section. The periodic cascading of acid between sections and the ability to run one section at a low acid concentration, results in more efficient use of acid (by consuming the acid to a lower concentration) lower acid consumption and lower waste treatment costs. Typically wire pickling systems are dumped (or partially drained) when the concentration drops below about 8% hydrochloric acid by weight. With our invention, the acid can be consumed down to less than 2% by weight.
3. Internal slots between the acid sections permit a continuous cascading acid flow from the final section through to the first section. This allows a continuous operation by metering fresh acid into the final section and overflowing spent acid from the first section. Our design provides operational flexibility with external valves and piping that permit interconnection between the acid sections if desired.
4. The acid is supplied by a high volume pump to the acid trays through acid headers. Each acid header has a row of holes or nozzles to eject the acid into the tray at high velocity thus creating high turbulence. The acid headers extend out the tank wall through a flange and union arrangement that permits rotation of the header. This acid header configuration has the advantage of being able to easily adjust the angle that the nozzles discharge acid into the acid trays thus optimizing the turbulence pattern.
5. In the event of a failure of one of the acid pumps our system can still pickle wire in the remaining sections, albeit at slightly reduced wire speeds.
6. The separate acid sections permit the installation of electrodes to provide an electrolytic "boost" as is common in bipolar and other electrolytic cleaning systems.
7. Other objects and advantages are that the overflow principle of the open topped acid tray simplifies both operation and fabrication.

Further objects and advantages of our invention will become apparent from a consideration of the drawings and ensuing description.

DRAWING FIGURES

List of reference Numerals

Figure 1:
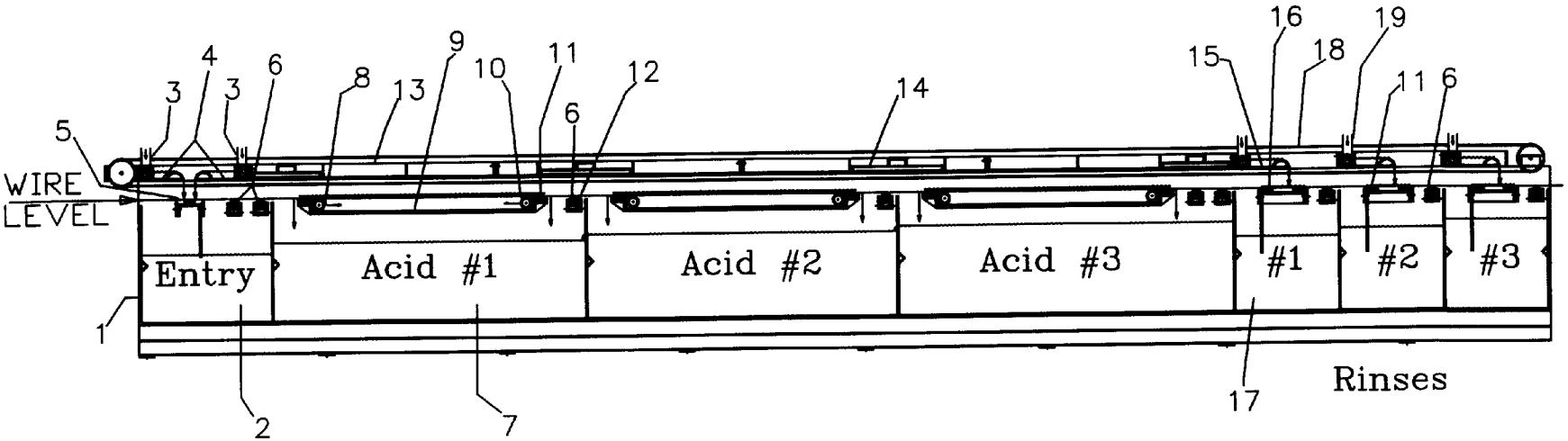
FIG. 1 is an Elevational View of the Apparatus

| | |
|---|---|
| 1. Main Tank | 15. Rinse Curtain |
| 2. Entry Reservoir | 16. Rinse Tray |
| 3. Entry Curtain Header | 17. Rinse Reservoir |
| 4. Entry Curtain | 18. Rinse Cover |
| 5. Entry Tray | 19. Rinse Header |
| 6. Wiping Bars | 20. Threading Channels |
| 7. Acid Reservoir | 21. Rope |
| 8. Acid Nozzles | 22. Shuttle Mechanism |
| 9. Acid Tray | 23. Entry Pump |
| 10. Acid Header | 24. Acid Pump |
| 11. Weir Bars | 25. Rinse Pump |
| 12. Wipe Supports | 26. Transfer Pipe |
| 13. Acid Hood | 27. Flow Meter |
| 14. Acid Cover | 28. Heat-Exchanger |

DESCRIPTION OF INVENTION

A High Turbulence Multiple Stage Pickling System is primarily constructed of a single long main tank (Item 1, FIG. 1) fabricated from fiber reinforced plastic (fiberglass with acid resistant resin and if desired reinforced with pultruded composite sections), thick polypropylene (about 1"with external stiffeners), or similar corrosion resistant material. Main tank 1 has dimensions that are dependent on the number and speed of wires being processed, but is generally 32 feet long by 5 feet wide by 4 feet high with ½ inch thick walls and internal partitions. Main tank 1 is subdivided by internal partitions into an Entry Section, Acid Sections (3 shown) and Rinse Sections (3 shown).

Entry Section

An entry reservoir (Item 2) forms the lower part of an entry section. An entry tray (Item 5) is constructed of polypropylene or similar acid resistant material. Entry tray 5 sits on a shelf built into the sidewalls of entry reservoir 2. Entry tray 5 supports a weir bar (Item 11) that in turn supports and defines the level of the wire field. Weir bars 11 (total of 13 shown in FIG. 1) are made of ceramic, granite or other wear and acid resistant material. Weir bars 11 are generally 1" to 2" thick by 2" to 4" wide and are made about as long as the inside width of main tank. Entry curtains (Item 4) (2 shown) span the width of the open top of main tank 1. Entry curtains 4 are constructed of polypropylene or similar acid resistant material. Entry headers (Item 3) (2 shown in FIG. 1) are generally made of CPVC schedule 80 pipe and fittings. Holes of about ⅜" diameter and spaced about 1" apart are drilled into the bottom of the header pipe. Wiping bars (Item 6) (two shown in the entry section of FIG. 1) are located downstream (with regard to the direction of wire travel) of, and at a similar level to, entry tray 5. Wiping bars 6 are made of ceramic, granite or other acid and wear resistant material and are 1" to 2" square by a length to suit the inside width of main tank 1. Wiping bars 6 are supported along their full length by wipe supports (Item 12).

Acid Sections

Figure 2:
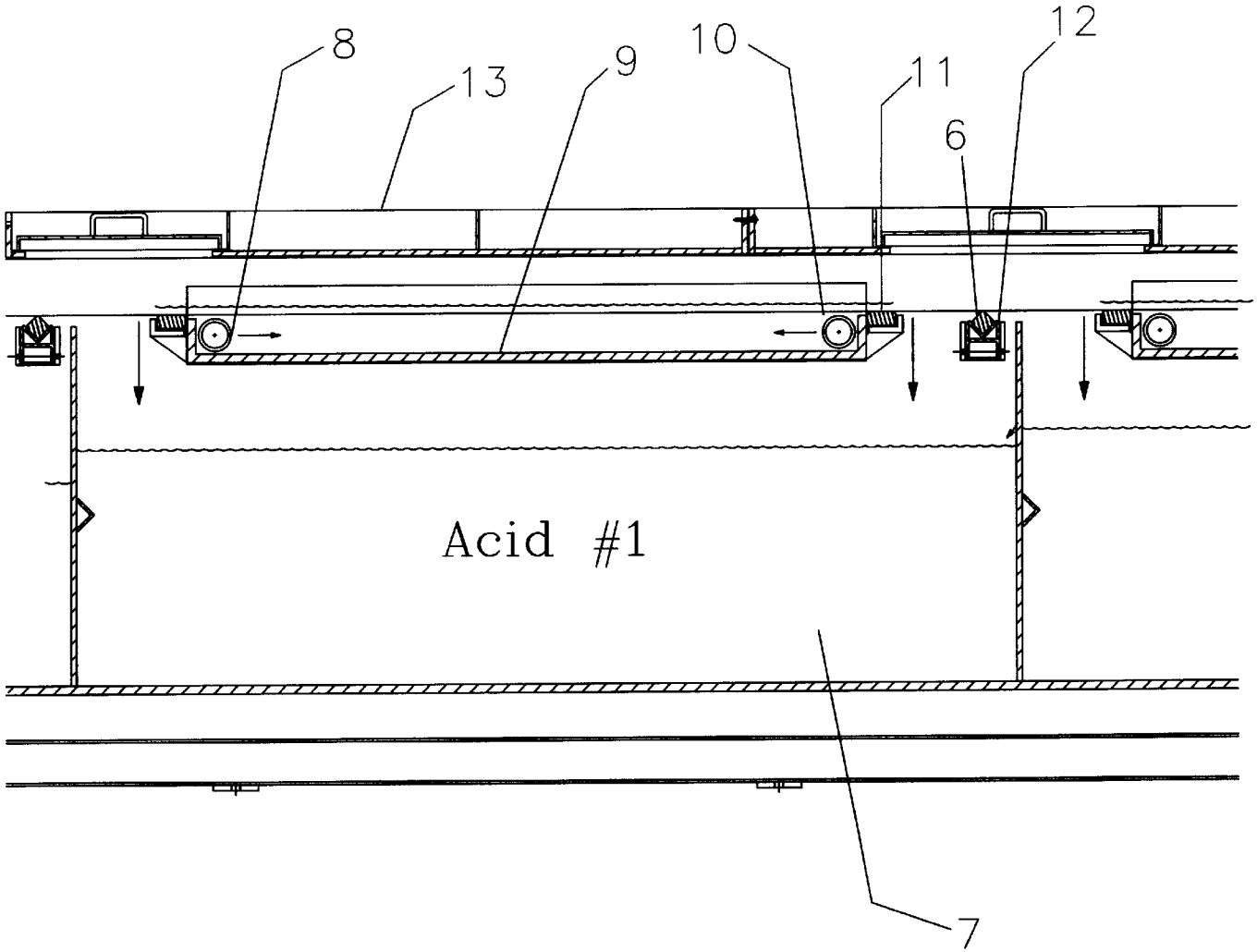
FIG. 2 is an Elevational View of an Acid Section
Figure 3:
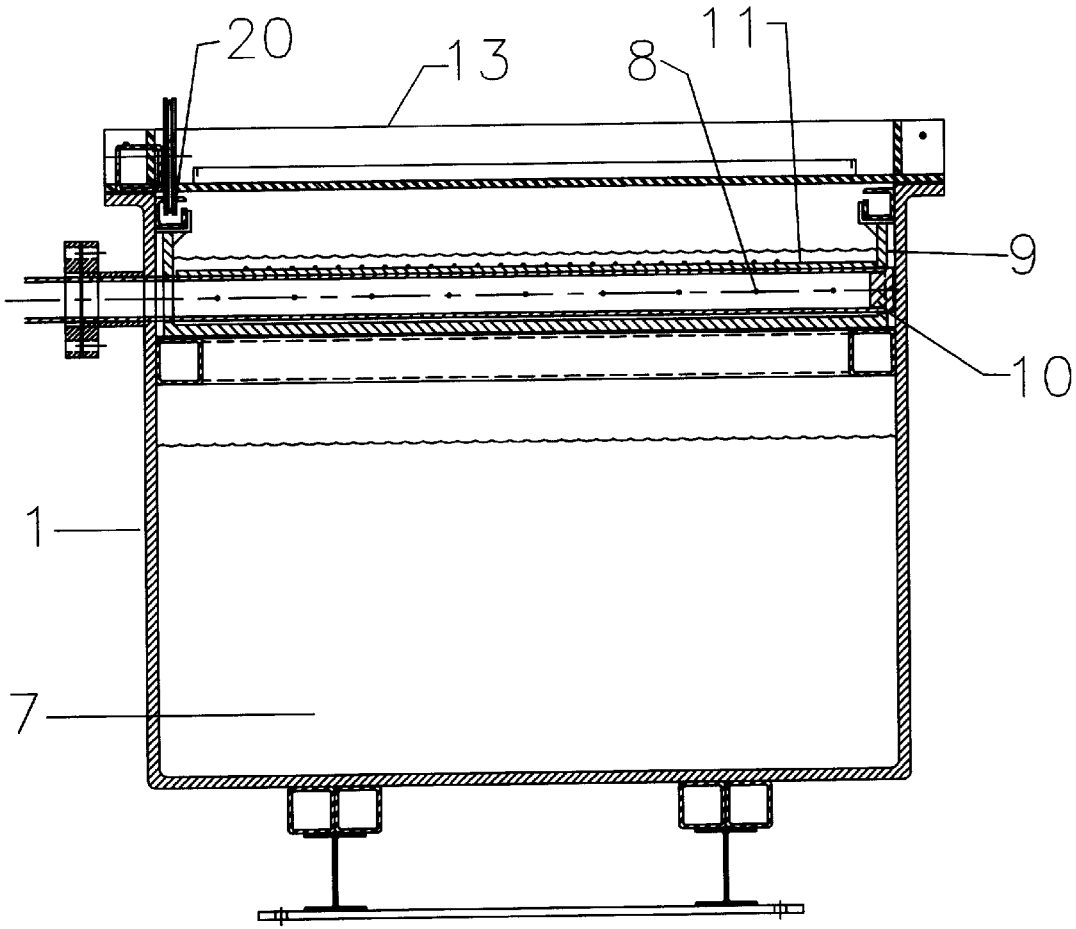
FIG. 3 is a Transverse Sectional View taken across an Acid Tray

An acid reservoir (Item 7) (3 shown in FIG. 1) forms the lower part of each acid section. An acid tray (Item 9), shown in detail in FIGS. 2 and 3, is constructed of ½" to ¾" thick fiberglass or similar acid resistant material. Acid tray 9 sits on a shelf built into the sidewalls of acid reservoir 7. FIG. 2 shows acid tray 9 supporting weir bars (Item 11) at the entry and exit ends of the tray. Weir bars 11 in turn support and define the level of the wire field through the acid section. Acid headers (Item 10) (2 shown in FIGS. 2) are generally made of 2 ½" CPVC schedule 80 pipe and fittings, and are laterally mounted at each end of acid tray 9. FIG. 3 shows acid headers 10 extending outboard through nozzles (or flanges) mounted in the sidewall of main tank 1. Each acid header 10 has a series of acid nozzles (Item 8) about ¼" diameter (design range=0.125" to 0.375" diameter) drilled at equally spaced intervals of about 5" (design range=3" to 7" pitch).

Alternate acid header sizes and configurations are possible. A square or rectangular header (possibly made of pultruded fiberglass material) with holes or nozzles near its top surface, and configured to minimize tray depth, will produce a desired turbulence pattern.

The top of the acid area is covered by fiberglass or polypropylene hoods (Items 13) (4 shown in FIG. 1). Acid hoods 13 are clamped to the top flange of main tank 1 and bolted together. Quick lift-off acid covers (Items 14) (4 shown in FIG. 1) are located at strategic positions along the covers to provide easy maintenance access to the weir bars 11 and wiping bars 6. Acid covers 14 are sealed to acid hood 13 by either a neoprene gasket or by having the cover legs sit in water filled troughs built into acid hoods 13.

Rinse Sections

Figure 4:
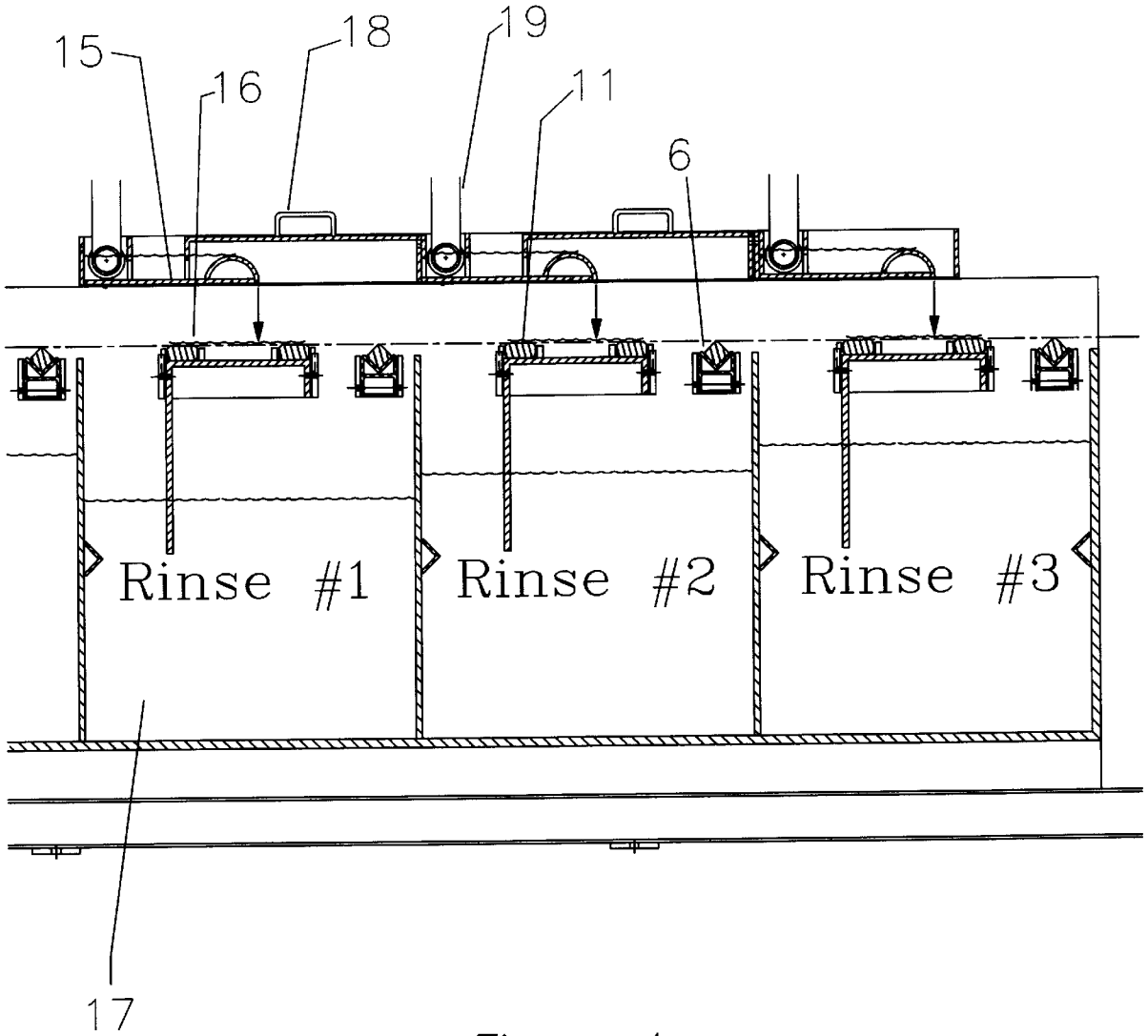
FIG. 4 is an Elevational View of the Rinse System

The rinse system (as shown in FIGS. 1 and 4) can be divided into two or more (3 shown) sections. A rinse reservoir (Item 17) forms the lower part of each rinse section. The internal partitions between rinse reservoirs are slotted at a certain height that determines fluid level. Rinse trays (Item 16) sit on a shelf built into the sidewalls of each rinse reservoir 17. Rinse tray 16 supports a weir bar (Item 11) that in turn supports and defines the level of the wire field. Rinse curtains (Item 15) are constructed of polypropylene or similar acid resistant material. Rinse headers (Item 19) (3 shown in FIG. 4) are generally made of CPVC schedule 80 pipe and fittings. Holes of about ⅜" diameter and spaced about 1" apart are drilled into the bottom of the header pipe. Wiping bars (Item 6) (3 shown in the rinse system of FIG. 4) are located downstream (with regard to the direction of wire travel) of, and at a similar level to, rinse tray 16. Rinse covers (Item 18) on the first and second rinse sections are made of polypropylene or similar material.

Threading Channels

Figure 6:
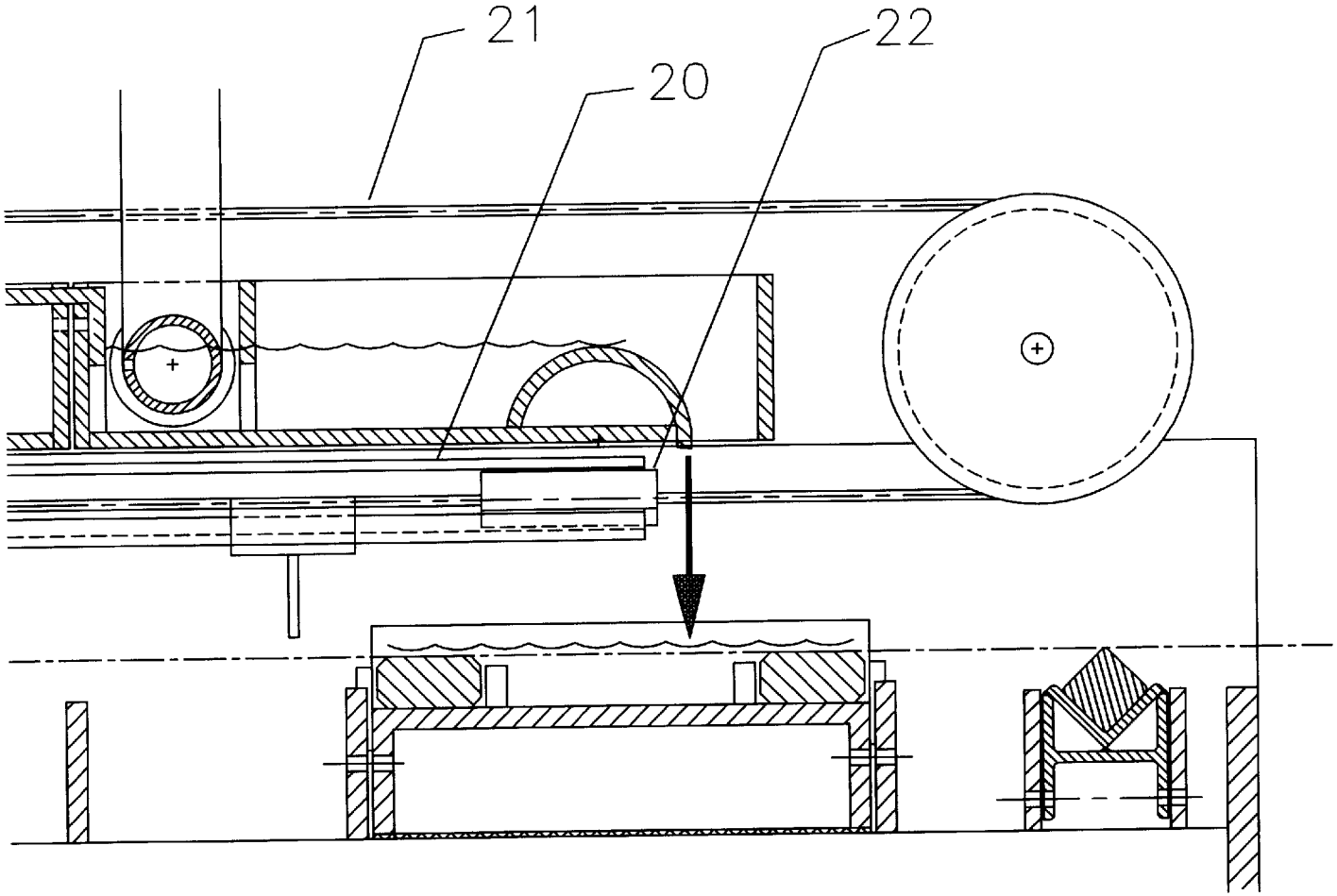
FIG. 6 is a Sectional Detail of Threading Channel Parts

FIGS. 3 and 6 show threading channels (Item 20) located along the upper inside wall of both sides of main tank 1. Threading channels 20 are fabricated from a 2" square (or similar sized) pultruded fiberglass material. FIG. 6 shows threading channel details including a polypropylene (or similar material) rope (Item 21) used to pull a shuttle mechanism (Item 22) through threading channels 20.

Operation of Invention

Generally, between 12 and 50 parallel laterally spaced wires moving horizontally along their axis, travel through an enclosed pickling space. The purpose of which is to remove the oxide layer from the surface of the wire in as short a time as possible. This invention increases the wire speed by shortening the pickling time.

Entry Section

The entry section serves to seal in acid fumes where the wires enter the pickling system. The entry pump (Item 23, FIG. 5) pumps water, from entry reservoir 2 through entry headers 3 to the entry curtains 4 located above the wire field. The water then overflows in laminar sheets to entry tray 5 below, effectively sealing in the fumes of the acid sections. A leg of entry tray 5 extends below the water level of the entry reservoir 2 to prevent fumes escaping below the tray. The wires contact the top of two wiping bars 6 which are used to wipe excess water from the bottom of the wires before they enter the first acid section.

Acid Section

In each acid section, the pickling fluid is pumped by the acid pump (Item 24, FIG. 5), at relatively high flow rates (about 80 to 140 USGPM @30 to 50'TDH for a typical 4' to 5' wide system) from the acid reservoir 7 to the acid header 10. Very good turbulent patterns are produced in acid trays 9 at nozzle exit velocities in the range of 25 to 50 ft/s. Acid headers 10 are located at each end of acid tray 9 with their nozzles pointed horizontally (or at a small angle off horizontal) towards the middle of the tray. The resulting opposing flows creates additional turbulence and increased fluid depth in the center section of the acid tray 10.

Typical operating conditions would be with the first section at 1%–2% HCI, 2nd section at 8% to 10% HCl and 3rd section at 14% to 18% HCl concentration.

Weir bars 11 are located at the inlet and exit ends of each acid tray 10 in order to support the wires, protect the tray, and maintain the correct fluid height. After the wires exit the acid tray they contact one or two wiping bars 6 that remove the acid drips prior to the wires proceeding to the next tank.

Rinse Section

Figure 5:
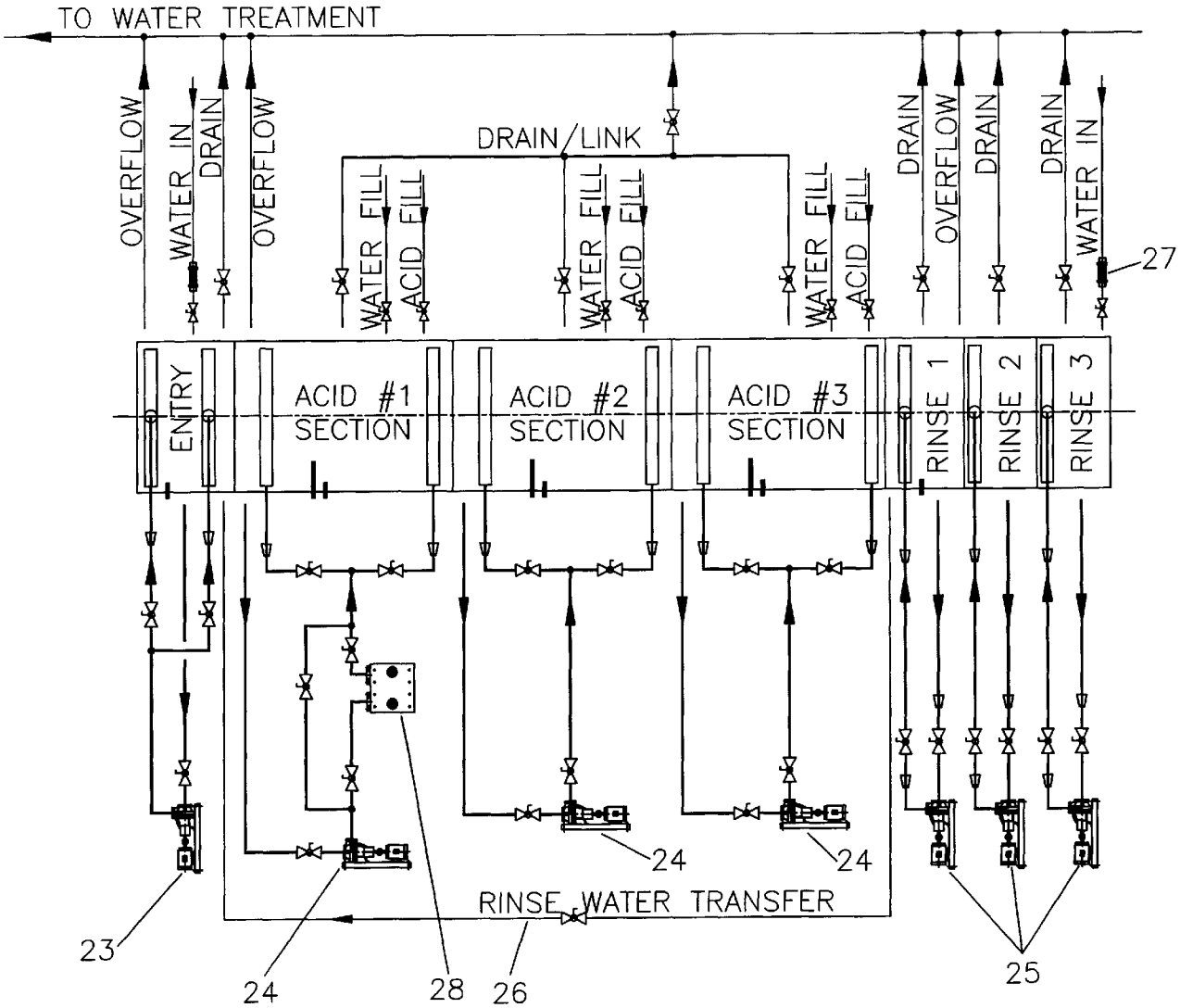
FIG. 5 is a Schematic Piping Diagram

The rinse system is divided into two or more (3 sections are shown in FIGS. 1, 4 and 5) sections the purpose of which is to rinse the acid from the wires and to seal the acid fumes in the acid tank. The wires are washed by progressively cleaner water as they pass through the rinse sections. In each rinse section the rinse pump (Item 25, FIG. 5) pumps water from the rinse reservoir 17, through rinse header 19, to the rinse curtain 15 located above the wire field. The water then overflows in a laminar sheet to rinse tray 16 below. These laminar rinse curtains effectively seal in the acid fumes at the exit end of the system. Each rinse tray 16 has a leg that extends below the water level of the rinse reservoir 17 to prevent fumes escaping below the tray.

Weir bars 11 at the entry and exit of each rinse tray serve the function of both supporting the wires and acting as weirs to flood the rinse tray 16. Each rinse section also includes a wiping bar 6 to minimize fluid carry over to the next section. Rinse covers 18 on the first and second rinse sections serve to prevent fumes from escaping vertically.

Fresh water (typically 5 to 8 USGPM) enters the final rinse section through a flow meter (Item 27, FIG. 5). The internal partitions between rinse sections are slotted to provide a cascading overflow to the subsequent rinse. Overflow water from the first rinse section is externally piped by a transfer pipe (Item 26, FIG. 5) to the entry curtain tank.

Threading Channels

Threading channels 20 located along both sides of the main tank 1 are used to thread strands of wire into the system. Rope 21 is used to pull shuttle mechanism 22 through the threading channels 20.

Control

Temperature control of the acid sections is obtained by one of three methods:

1. Submerged flexible Teflon (or similar material) tube bundles heated by steam.
2. Carbon graphite (or similar) external heat-exchanger (Item 28, FIG. 5) mounted in the acid re-circulating piping.
3. By controlling the temperature of the wires entering the system (if an upstream heat-treatment process is part of the wire line).

The High Turbulence Multiple Section Pickling System design includes an electrical control panel with temperature indicators/controllers, pump motor starters, heater controls, push-buttons, lights, control transformer and optional computer hardware and software package. A computer package option provides man-machine interface (MMI) and supervisory control and data acquisition (SCADA) functions.

Theory of Operation

While we believe the rate of the pickling reaction is significantly increased by the following fluid dynamics, we don't wish to be bound by this.

General

The system's multiple flooded fluid sections are designed so that the wires maintain a consistent horizontal level (straight through wire path). The continuously running parallel strands of wire (or other small cross sectional material) enter the system at the entry tank that serves primarily as a double fume seal, although this tank can also be used to cool the wires (quench operation). The Acid Section is designed to operate at temperatures between 50° F. and 200° F. with acid concentrations between 1% and 25% HCl by weight.

Chemical Reactions

The basic chemical reaction between hydrochloric acid and the oxidized surface of the steel wire can be summarized as follows:

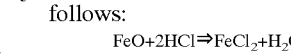

$$FeO+2HCl \Rightarrow FeCl_2+H_2O$$

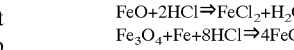

$$Fe_3O_4+Fe+8HCl \Rightarrow 4FeCl_2+4H_2O$$

The penetration of acid through the cracks in the oxidized surface and the subsequent reaction with the base metal also contributes to the pickling process. The formation of hydrogen at the base metal helps to mechanically eject the surface scale.

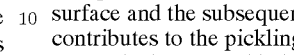

$$Fe+2HCl \Rightarrow FeCl_2+H_2(g)$$

The above reactions deplete the acid, lowering its concentration in the immediate vicinity of the wire surface. Unless fresh acid is continuously supplied to the wire surface the pickling rate is slowed down as a pocket of spent acid persists around the wires. Thus the overall speed of pickling depends greatly on the fluid dynamics of the system.

Fluid Flow Characteristics

In a typical continuous in-line wire pickling system the wire is pulled longitudinally through a processing tank. In most current systems this is a flood weir tray with a pickling solution of low velocity laminar flow, therefore the relative speed between fluid and the wire is primarily due to the wire's speed. The relative direction between fluid and the wire is collinear with the wire since very little lateral fluid movement is observed. This situation is quite similar to the classic laminar fluid flow over a flat plate.

Studies of laminar flow show that a relatively thick boundary layer (δ) develops above a solid surface. The boundary layer is the portion of flow in the vicinity of the surface that is slowed by frictional effects. Within the laminar boundary layer the flow velocity varies from zero at the solid surface to free stream velocity at the outboard edge of the layer. In fully developed turbulent flow the effective boundary layer is reduced to a thin laminar sublayer (δ*) as shown below.

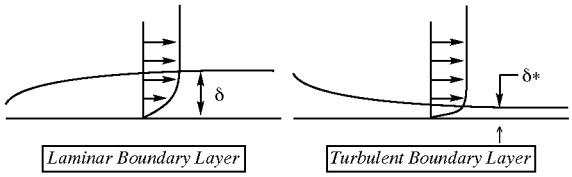

We conclude that when the collinear relative velocity between the wires and the pickling fluid is increased to an optimum, the flow regime becomes turbulent and the thin boundary layer permits fresh acid to reach the wire.

In the operation of the High Turbulence Pickling System the acid is pumped to the acid tray in a manner optimized to produce the maximum turbulence in the tray. The relative velocity will no longer be simply collinear since the acid will approach the wires from a multitude of directions. Thus the flow characteristics will, at times, be similar to flow past an infinitely long cylinder as shown below.

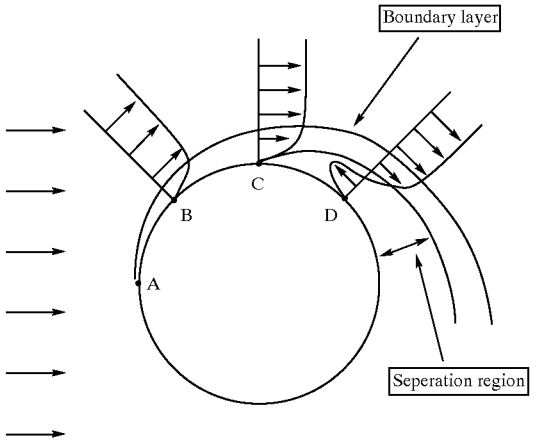

*Boundary Layer with Separation Region (flow normal to cylinder)*

The boundary layer begins its growth at Point A (stagnation point) on the leading edge of the cylinder, which in the HTPS could be the side, top, or bottom of the wire. Boundary growth continues through Point B in a normal fashion until an adverse pressure gradient starts to change the flow pattern at Point C. This results in a Separation Region forming on the downstream side of the cylinder in which the flow direction is reversed, as indicated by Point D. This separation region is characterized by vortices, swirls and reverse flow.

The High Turbulence Pickling System flow design will maximize the turbulence of the pickling acid thus providing multiple mini-regions of flow lateral to the wire direction. The continuously reversing flow combined with the vortices and swirls will supply fresh acid to the wire surface and additionally act like a mechanical scrubber.

Conclusion, Ramification, and Scope of Invention

Thus the reader will see that the High Turbulence Multiple Stage Wire Pickling System invention represents a significant improvement in the state of the art of wire pickling equipment. The invention's high turbulence improves pickling performance and shortens pickling time. The multiple stages permit greater efficiency and lowers acid consumption as well as reducing the cost associated with treating and neutralizing waste water.

While the above description contains many specificities, these should not be construed as limitations on the scope of the invention, but rather as an exemplification of one preferred embodiment thereof. Many other variations are possible. For example; longitudinally mounted acid headers, multiple smaller acid trays supplied by one or more pumps, and acid supplied to the acid trays through spray nozzles mounted above the wire field.

Accordingly, the scope of the invention should be determined not by the embodiments illustrated, but by the appended claims and their legal equivalents.

What we claim is:

1. A wire pickling apparatus comprising:

a) an elongated tank having a cover, a bottom, two side walls, two opposing end walls, said end walls having horizontally aligned openings, and a plurality of partition means which divide said tank into a plurality of cells, at least two cells for water and a plurality of cells therebetween for pickling fluid, b) a means of sealing said horizontally aligned openings of said tank with water curtains in conjunction with rinse trays, c) a plurality of acid trays disposed in the pickling fluid cells, d) said acid trays having weirs at each end and a means of forming turbulence in conjunction with said pickling fluid flooding said acid trays and overflowing said weirs, e) said turbulence forming means comprises two opposed pipe headers located across said acid tray width, with a series of co-linear holes or nozzles in said pipe headers, each of said nozzles aligned substantially horizontally and longitudinally and positioned in said acid trays below a wire level in said acid trays for ejecting said pickling fluid into the bottom of said acid trays, f) means for passing wire horizontally from an entrance end of said tank, to an exit end of said tank, at a level of the top of said weirs which permits said wire to be submerged sequentially in the turbulent pickling fluid of said acid trays, whereby the turbulent pickling fluid of said plurality of acid trays will effectively clean said wire.

2. The apparatus of claim 1 wherein a plurality of said wires, arranged in side-by-side laterally-spaced relationship, pass simultaneously through said acid trays, submerged in said turbulent pickling fluid.

3. The apparatus of claim 2 wherein said tank comprises additional means of forming a rinse zone in conjunction with water from said water curtain located at the exit end of said tank.

4. The apparatus of claim 3 wherein said tank further comprises additional means of forming at least one additional water curtain and rinse zone located at the exit end of said tank.

5. The apparatus of claim 2 wherein a double water curtain is employed at the entry end of said tank.

6. The apparatus of claim 1 wherein said acid tray comprises; one of said pipe headers positioned at the entry end of said acid tray, and one of said pipe headers positioned at the exit end of said acid tray, and each of said nozzles aligned substantially horizontally and pointed towards the middle of said acid tray.

7. The apparatus of claim 1 wherein said pickling fluid overflowing said weirs is collected in the bottom of the pickling fluid cell and conduit means is provided connecting said cell to said means of forming turbulence for recycling of said pickling fluid.

8. The apparatus of claim 1 wherein said means of forming turbulence comprises a plurality of nozzles positioned vertically above said wire to eject pickling fluid substantially vertically down into said acid tray.

* * * * *